US010398993B1

(12) United States Patent
Forti

(10) Patent No.: US 10,398,993 B1
(45) Date of Patent: Sep. 3, 2019

(54) FLOATING PHANTOM ILLUSION

(71) Applicant: William Mark Corporation, Claremont, CA (US)

(72) Inventor: William Mark Forti, Claremont, CA (US)

( * ) Notice: Subject to any disclaimer, the term of this patent is extended or adjusted under 35 U.S.C. 154(b) by 0 days.

(21) Appl. No.: 15/945,584

(22) Filed: Apr. 4, 2018

Related U.S. Application Data

(60) Provisional application No. 62/489,350, filed on Apr. 24, 2017.

(51) Int. Cl.

| | |
|---|---|
| ***A63H 27/00*** | (2006.01) |
| ***A63H 3/06*** | (2006.01) |
| ***A63H 3/26*** | (2006.01) |
| ***A63J 19/00*** | (2006.01) |
| ***A63H 33/26*** | (2006.01) |
| *A63H 3/00* | (2006.01) |
| *A63H 3/14* | (2006.01) |
| *A63J 21/00* | (2006.01) |
| *A63H 3/28* | (2006.01) |

(52) U.S. Cl.
CPC ..... *A63H 3/26* (2013.01); *A63H 33/26* (2013.01); *A63J 19/006* (2013.01); *A63H 3/006* (2013.01); *A63H 3/14* (2013.01); *A63H 3/28* (2013.01); *A63J 21/00* (2013.01)

(58) Field of Classification Search
CPC . A63H 3/006; A63H 3/14; A63H 3/26; A63H 3/28; A63H 27/10; A63H 2027/1008; A63H 2027/1041; A63H 2027/1058; A63H 2027/1066; A63H 2027/1075; A63J 19/006; A63J 21/00
USPC ..... 446/26, 220, 223, 226, 359
See application file for complete search history.

(56) References Cited

U.S. PATENT DOCUMENTS

| | | | | | |
|---|---|---|---|---|---|
| 1,536,816 | A * | 5/1925 | Sale | A63H 27/10 | 446/220 |
| 5,030,162 | A * | 7/1991 | Hall | A63H 3/14 | 428/3 |
| 5,096,453 | A * | 3/1992 | Van Meter | A63H 3/46 | 446/369 |
| 5,117,344 | A * | 5/1992 | Perez | A63H 27/10 | 362/190 |
| 5,672,396 | A * | 9/1997 | Zinbarg | A63H 3/06 | 428/12 |
| 5,765,831 | A * | 6/1998 | Huffhines | A63H 27/10 | 273/348.4 |
| 5,820,243 | A * | 10/1998 | Chang | F21V 3/023 | 362/470 |
| 5,888,596 | A * | 3/1999 | Zinbarg | A63H 3/06 | 428/12 |
| 6,001,434 | A * | 12/1999 | Zinbarg | A63H 3/06 | 428/12 |
| 6,019,661 | A * | 2/2000 | Simpkins | A63H 11/04 | 446/228 |
| 6,602,105 | B1 * | 8/2003 | Sussell | A63H 27/10 | 362/253 |

(Continued)

*Primary Examiner* — Alexander R Niconovich
(74) *Attorney, Agent, or Firm* — Umberg Zipser LLP

(57) ABSTRACT

A toy kit and components for a floating illusion is presented in which a manipulator releaseably engages via a coupling element with a composite structure. Preferred composite structures include first and second, sheet-like portions in which at least one portion has a face or head feature in registration with a coupling element.

7 Claims, 2 Drawing Sheets

(56) References Cited

U.S. PATENT DOCUMENTS

2006/0223411 A1* 10/2006 Burchett ..... A63H 27/04
446/226

* cited by examiner

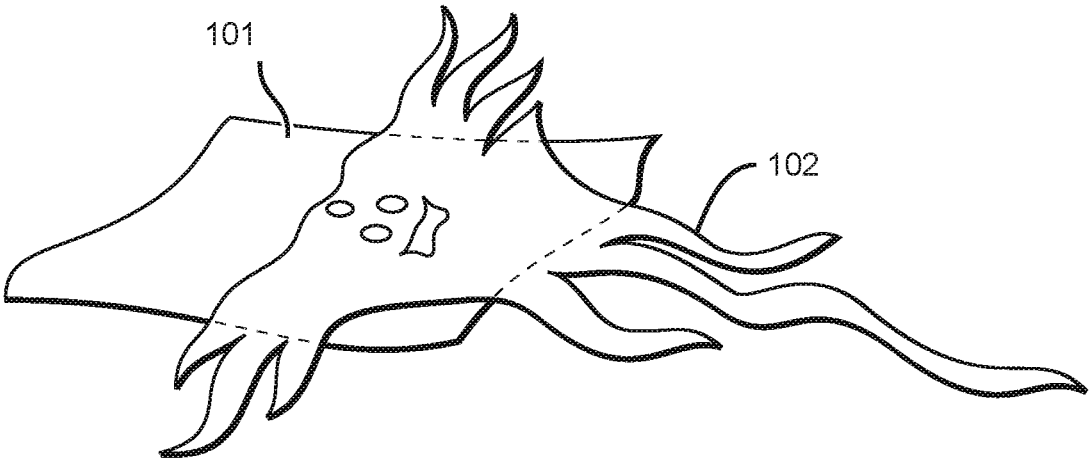
FIG. 1
FIG. 2
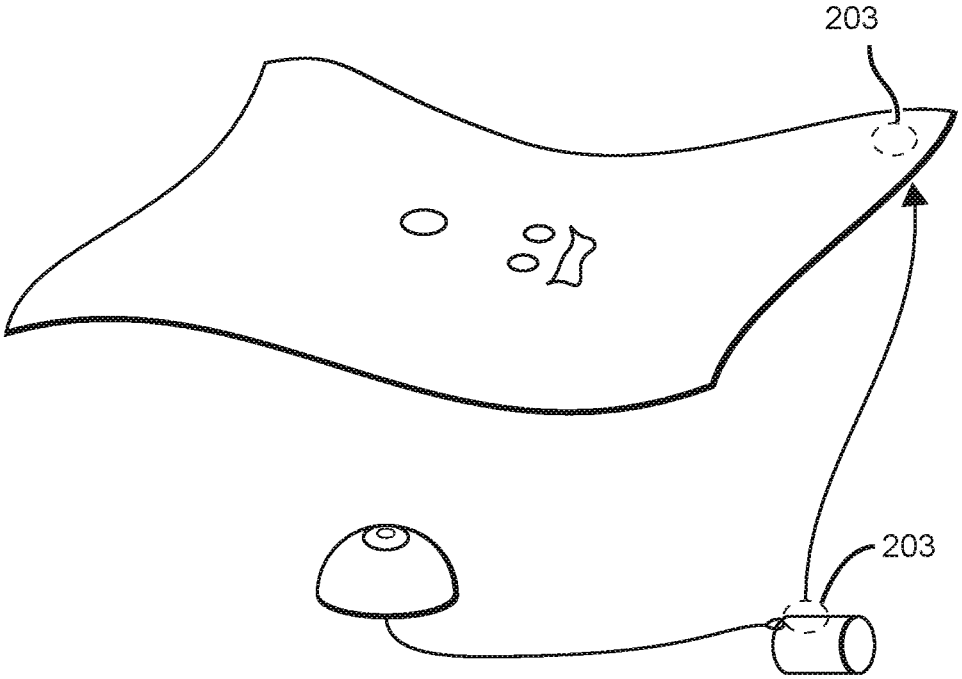

FLOATING PHANTOM ILLUSION

This application claims priority to U.S. provisional patent application with the Ser. No. 62/489,350, filed Apr. 24, 2017.

FIELD OF THE INVENTION

The field of the invention is toys, and particularly a flexible shape that appears to float in midair.

BACKGROUND OF THE INVENTION

The background description includes information that may be useful in understanding the present invention. It is not an admission that any of the information provided herein is prior art or relevant to the presently claimed invention, or that any publication specifically or implicitly referenced is prior art.

Audiences have long been fascinated by magic tricks in which an object appears to float in the air without visible means of support. The illusion is made stronger if the means of support can remain concealed and even be removed by the user so that the user can demonstrate that the means of support is not there and so the audience can freely examine the floating material. The illusion is also stronger if the material can appear to move independent of the user's movements. However, most magic tricks where toys are suspended and float midair are complex and often require significant user experience.

Thus, there remains a need for devices and methods that allow performance of a magic trick with a floating object that is simple, effective, and that does not require significant user experience.

SUMMARY OF THE INVENTION

The inventive subject matter is directed to various devices, kits, and methods that allow a user to perform a magic trick in which an object is moved through the air in a floaty motion. In especially preferred aspects, a toy kit comprises a user-operable manipulator and a generally soft and flowing composite structure. It is also further preferred that the composite structure and the manipulator cooperate to produce a head/facial feature during operation that can be maintained even when the toy is rapidly moving.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1 is an exemplary illustration of a component of a toy according to the inventive subject matter.

FIG. 2 is an exemplary illustration of a component of the toy of FIG. 1 with a hand-held manipulator.

DETAILED DESCRIPTION

Figure 3:
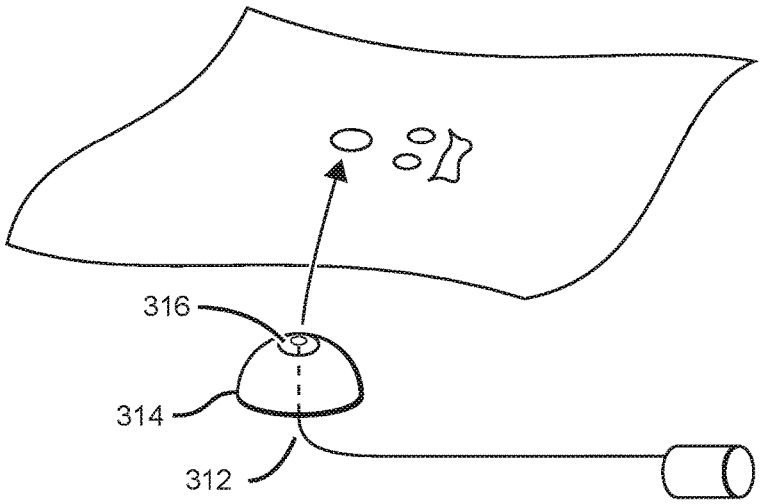
FIG. 3 is another exemplary illustration of a component of the toy of FIG. 1 with an attachment mechanism according to the inventive subject matter.

The inventive subject matter is directed to a kit and components for such kit that allow a user to perform a floating phantom illusion. For example, preferred floating illusions include those that generally move in a non-linear motion, and especially those in form of a ghost, dragon, fairy, flame, smoke, etc. In further preferred aspects, the kit may include a composite structure that comprises at least two portions of any flexible, readily deforming, and undulating material (e.g., cloth, gauze, netting, or fabric). The first portion may be less transparent than the second and the second portion may have less weight and greater flowability than the first portion. For example, the second portion may be made of a gauzy cloth or see-through netting such as that used for a veil, while the first portion may have a face or other head feature imprinted thereon. It should further be appreciated that the first and second portions are coupled to each other such that at least some of the portions can move independently of each other to enhance the flowing impression. Moreover, with respect to the face or head feature, it should be appreciated that the second portion will not cover up the feature (e.g., may be positioned in a cutout or underneath a more transparent portion). As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The size of the composite structure may measure one to six feet long and wide, preferably about two feet square, and have a thickness of less than one millimeter. While not limiting to the inventive subject matter, the second portion 102 will at least in some places extend beyond the first portion 101 to so enhance the flowing illusion. Therefore, the first portion 101 may be made of a cloth and have a generally square shape (e.g., 60 cm×60 cm) and have the face/head feature centrally located on one side of the cloth, while the second feature may be a sheer or thin netting with long streamer-type extensions that stretch beyond the edge of the first portion. The portion of the composite material with higher flowability may have edges cut into strips to increase the flowing illusion, while the more opaque portion may also have cut edges. Most typically, the head or face feature will be in registration with a coupling feature as is exemplarily depicted in FIG. 1.

Contemplated kits may also contain a manipulator comprised of a proximal and distal end with an oblong element connecting the ends. The oblong element may be made of metal, plastic, wire or another relatively rigid material and may be 3 inches to 48 inches long, preferably about twelve inches long. The manipulator can include a spring-like function or have an otherwise resilient structure that allows the element to "bounce" or move independently of the user while in operation or attached to a stand or wall.

Most typically, the proximal portion of the manipulator may attach to the user's finger, arm, or other body part in a removable manner and be made of any suitable material. Therefore, suitable proximal portions may be configured as or include a ring, glove, coiled wire, wrist band, grasping element, or clamp. The proximal end may also removably couple with the corner, edge, or other portion of the composite structure (e.g., using Velcro 203, magnet, adhesive, etc.) in order to further conceal the manipulator from the audience's view as is illustrated in FIG. 2.

The distal end 312 of the manipulator may have a coupling feature 316 such as a magnet, Velcro or adhesive able to connect and disconnect to the coupling feature 316 in the first or second portion of the composite structure. Moreover, it is generally preferred that the distal end 312 may also be shaped such as to cooperate with the face or head feature on the composite structure to produce an appearance of a head shape. Thus, the distal end may be configured as or include a conical, circular, spherical, triangular, ovular, etc. shape 314 as is exemplarily shown in FIG. 3. As will be readily appreciated, the distal end may be made of any suitable material, including polymeric materials, inflatable materials, etc. Moreover, it is contemplated that additional effects may be included in the distal end, such as acoustic elements, motion sensors, vibrating elements, optical elements, etc.

Figure 4:
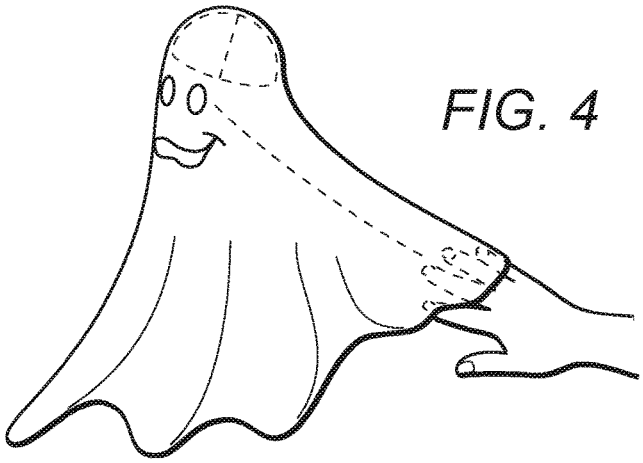
FIG. 4 is one exemplary illustration of use of the toy of FIG. 1.

In operation, the user may attach the proximal end of the manipulator to a finger or other body part, then drape the composite structure over the distal end of the manipulator. As noted above, the composite structure may attach to the distal end in a removable manner by a coupling feature and will so engage to form the appearance of a head with a face feature as can be seen from FIG. 4. It should be noted that the distal end of the manipulator and the face/head feature of the composite structure are maintained in registration via the coupling feature and therefore allow rapid motion without loss of the appearance of the head.

Figure 5:
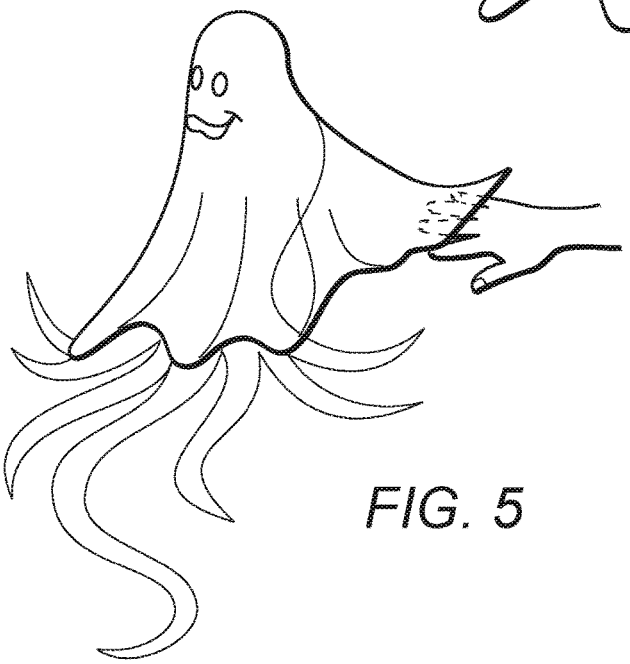
FIG. 5 is another exemplary illustration of use of the toy of FIG. 1.

The user conceals the entire manipulator from the audience using the composite structure. The user then moves the finger (or other body part) to which the proximal end is attached. The composite structure moves also and appears to float and flow in midair. The face or head shape in the composite structure may make the composite structure look like a ghost, dragon, fairy, flame smoke, wisp or other creature/object. The head shape can register with a face, hood, hair, arms, legs or other feature that is printed, glued or otherwise adhered to the composite structure. The user may tell the audience that this is his or her "pet ghost," speaking to it and having it respond with movement, light and/or sound as is exemplarily shown in FIG. 5.

After performing the illusion, the user may secretly remove the manipulator from under the composite structure and conceal it from the audience. Then the user may display both sides of the composite structure to the audience, thus reinforcing the illusion of it floating in midair. The user can even hand the de-coupled composite structure to audience members to examine.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A kit, comprising:

a composite structure comprising a first and a second portion coupled to each other such that the first portion lies on top of the second portion, wherein the first and second portions are configured as a sheet;

wherein the second portion has streamers and/or edges cut into strips, extends at least in some places beyond the first portion, and has a higher transparency and flowability than the first portion, and wherein the first portion has a face or head feature in registration with a first coupling element;

a manipulator having a proximal end and a distal end, the ends coupled together via an extended portion, wherein the distal end comprises a second coupling end that is configured to releaseably couple with the first coupling element;

wherein the distal end comprises or is configured as a cone or as at least a portion of a sphere, and wherein the first and second coupling elements are disposed on the composite structure and the distal element such that the composite structure drapes with both first and second portions over the distal end; and wherein the proximal end includes or forms a ring, glove, coiled wire, wrist band, grasping element, or clamp for removable attachment to a user.

2. The kit of claim 1 wherein at least one of the first and second portions are configured as a sheet.

3. The kit of claim 1 wherein at least one of the first and second portions comprises streaming extensions.

4. The kit of claim 1 wherein at least one of the first and second coupling elements comprise a magnetic portion or a hook and loop fastener portion.

5. The kit of claim 1 wherein the extended portion of the manipulator comprises a wire or a spring.

6. The kit of claim 1 wherein the manipulator comprises an acoustic feature, an optical feature or a vibrating feature.

7. A toy with a flowable polymer or textile sheet, comprising:

a face or head feature on the sheet in registration with a coupling element, wherein the coupling element comprises a magnetic portion or a hook and loop fastener portion;

wherein the coupling element is configured to releaseably drape the sheet over a cone or at least portion of a sphere via a corresponding coupling element of a manipulator;

wherein the corresponding coupling element of the manipulator comprises a magnetic portion or a hook and loop fastener portion;

wherein the manipulator is a wire or spring and has a first end to which is coupled the cone or at least portion of the sphere that includes the corresponding coupling element of the manipulator; and wherein the manipulator has a second end to which is coupled a ring, a glove, a coiled wire, a wrist band, a grasping element, or a clamp.

* * * * *